US006723965B2

(12) United States Patent
Ohkuma et al.

(10) Patent No.: US 6,723,965 B2
(45) Date of Patent: Apr. 20, 2004

(54) HEATER CONTROL APPARATUS OF AIR-FUEL RATIO SENSOR AND METHOD THEREOF

(75) Inventors: Shigeo Ohkuma, Atsugi (JP); Hiroyuki Ohsaki, Atsugi (JP)

(73) Assignee: Unisia Jecs Corporation, Kanagawa-ken (JP)

( * ) Notice: Subject to any disclaimer, the term of this patent is extended or adjusted under 35 U.S.C. 154(b) by 384 days.

(21) Appl. No.: 09/886,222

(22) Filed: Jun. 22, 2001

(65) Prior Publication Data

US 2001/0054608 A1 Dec. 27, 2001

(30) Foreign Application Priority Data

Jun. 22, 2000 (JP) ..... 2000-187673

(51) Int. Cl.[7] ..... H05B 1/02

(52) U.S. Cl. ..... 219/497; 219/492; 219/505; 123/179.16

(58) Field of Search ..... 219/481, 492, 219/497, 499, 501, 505, 203, 204, 205; 123/179.16; 374/183, 142

(56) References Cited

U.S. PATENT DOCUMENTS 5,353,774 A * 10/1994 Furuya ..... 123/685
5,433,185 A * 7/1995 Toyoda ..... 123/682
6,188,049 B1 * 2/2001 Osaki ..... 219/497

FOREIGN PATENT DOCUMENTS

| | | |
|---|---|---|
| JP | 61-122556 | 6/1986 |
| JP | 10-26599 | 1/1998 |
| JP | 11-264811 | 9/1999 |

* cited by examiner

*Primary Examiner*—Mark Paschall
(74) *Attorney, Agent, or Firm*—Sughrue Mion, PLLC

(57) ABSTRACT

According to the present invention, when controlling a heater in an air-fuel ratio sensor, a crack of sensor element due to an exhaust condensed water is certainly avoided. To this end, an element temperature is detected by measuring an impedance of the sensor element and a power supply amount to the heater for heating the sensor element is feedback controlled so that the element temperature reaches a target temperature. Here, the target temperature is set to a lower side temperature, compared to other conditions, on a condition that a wall temperature of an exhaust system is low and a water content in the exhaust is condensed in the exhaust system. Or, an initial value of the power supply amount is set corresponding to the element temperature before the start of power supply to the heater. Or, an increase component of the power supply amount is set corresponding to the element temperature, and the power supply amount to the heater is feedforward controlled so as to be increased gradually by each predetermined increase component from a predetermined initial value.

29 Claims, 9 Drawing Sheets

HEATER CONTROL APPARATUS OF AIR-FUEL RATIO SENSOR AND METHOD THEREOF

FIELD OF THE INVENTION

The present invention relates to a heater control apparatus and a heater control method of an air-fuel ratio sensor which is mounted to an exhaust system in an internal combustion engine and equipped with a heater for heating a sensor element.

DESCRIPTION OF THE RELATED ART

Heretofore, an air-fuel ratio control apparatus of an internal combustion engine is known that detects an actual air-fuel ratio based on the oxygen concentration in the exhaust and the like using an air-fuel ratio sensor, and feedback controls a fuel supply quantity to the engine so that the actual air-fuel ratio reaches a target air-fuel ratio.

In order to perform the above-mentioned air-fuel ratio feedback control, it is precondition that the air-fuel ratio sensor is already activated. Since the air-fuel ratio sensor is activated when the temperature of the element thereof reaches a predetermined activation temperature, as shown in Japanese Unexamined Patent Publication No. 11-264811, the air-fuel ratio sensor is equipped with a heater for heating the sensor element, thereby controlling the power supply to the heater after an engine start.

Specifically, the power supply to the heater is controlled after the engine start (duty-control). At first, the power supply is made in an initial duty value set based on a cooling water temperature at the engine start, and a power supply amount is increased gradually with the lapse of time so that a maximum duty value can be obtained within a predetermined control time after the engine start. The reason the power supply to the heater is increased gradually with the lapse of time is that the quick activation of the sensor element can be performed well while preventing a damage of the sensor element due to a heat shock.

On the other hand, Japanese Unexamined Patent Publication No. 61-122556 discloses that, for the purpose of controlling a power supply amount to a heater for heating a sensor element equipped in an air-fuel ratio sensor based on an element temperature, the element temperature is detected using an impedance of the sensor element since the impedance of the sensor element depends on the element temperature.

Specifically, an alternating voltage with high frequency is applied to the sensor element of the air-fuel ratio sensor, and the impedance of the sensor element is measured by a current value (amplitude) flowing in the sensor element caused by the application of the alternating voltage, thereby detecting the element temperature from the measured impedance.

In Japanese Unexamined Patent Publication No. 10-26599 is disclosed a feedback control of power supply amount to a heater so that an impedance of a sensor element reaches a target impedance.

In a heater control apparatus of an air-fuel ratio sensor, the exhaust performance is required to be improved in such a way that a power supply amount to the heater after an engine start is possibly made large, to raise rapidly an element temperature, and as a result, the quick activation of sensor element is achieved to promote the start of an air-fuel ratio feedback control. On the other hand, in a state where a wall temperature of an exhaust system is low, a water content in the exhaust discharged from the engine is condensed, that is, a state where the condensed water is generated, if the element temperature of the air-fuel ratio sensor rises up, the element is cracked by a heat shock when the condensed water is in contact with the sensor element. Accordingly, it is preferable that a rise of the element temperature is restrained until the water content exceeds a dew point.

Therefore, in a heater control apparatus disclosed in Japanese Unexamined Patent Publication No. 11-264811, a control to restrain the rise of element temperature is performed. However, since this heater control is a uniform control without monitoring an actual element temperature, in a case where there are variations in each sensor due to an element shape, a heater capacity, deterioration and the like, or variations in heater control circuit including a voltage fluctuation, and further in case where a condensation generation condition is varied due to variations of environmental conditions such as an atmospheric temperature, rain and the like, there causes a problem in that the element crack due to exhaust condensed water is unavoidable.

SUMMARY OF THE INVENTION

The present invention, in view of the foregoing problems, has an object of providing an apparatus and a method for controlling a heater in an air-fuel ratio sensor, which can avoid an element crack of the air-fuel ratio sensor due to exhaust condensed water when performing a heater control of the air-fuel ratio sensor.

Therefore, according to the present invention, an element temperature of a sensor element of an air-fuel ratio sensor is detected by measuring an impedance of the sensor element, a target temperature of the element temperature is set and a power supply amount to a heater is feedback controlled so that the element temperature reaches the target temperature, and the target temperature of the element temperature is restrained to a lower temperature side, compared to other conditions, on a condition that a water content in the exhaust is condensed in an exhaust system.

According to this construction, the element temperature is detected by measuring an impedance of the sensor element of the air-fuel ratio sensor, and when the power supply amount to the heater is feedback controlled so that the element temperature reaches the target temperature, the target temperature is set at the lower temperature side on the condition that the water content is condensed. As a result, an element crack due to the exhaust condensed water can be avoided by maintaining the element temperature at a low temperature, and on the other conditions, the sensor element can be activated quickly by setting the target temperature at a higher temperature side. Further, since the feedback control is performed by detecting the element temperature by the impedance having a high correlation therewith, without an influence of variations in components the element crack due to the exhaust condensed water can be avoided certainly.

Further, according to the present invention, an element temperature of a sensor element of an air-fuel ratio sensor is detected by measuring an impedance of the sensor element, a target temperature of the element temperature is set and a power supply amount to a heater is feedback controlled so that the element temperature reaches the target temperature, and the target temperature of the element temperature is restrained to a lower temperature side, compared to other conditions, on a condition that a water content in the exhaust is condensed in an exhaust system.

More specifically, an initial value of power supply amount to the heater is set corresponding to the element temperature before the start of power supply to the heater. The power supply amount to the heater is set to the initial value when the power supply to the heater is started. After starting the power supply to the heater, the power supply amount to the heater is feedback controlled so that the element temperature reaches a predetermined target temperature.

Here, the initial value of the power supply amount to the heater is set smaller as the element temperature before the start of power supply to the heater is lower.

According to this construction, the element temperature is accurately detected by measuring the impedance of the sensor element of the air-fuel ratio sensor, and when the power supply amount to the heater is feedback controlled so that the element temperature reaches the target temperature, the initial value of the power supply amount to the heater is set corresponding to the element temperature before the start of power supply to the heater. Thus, an element crack due to the exhaust condensed water can certainly be avoided by delaying the rise of the element temperature (small initial value) when the element temperature is low and the water content in the exhaust is likely to be condensed. On the contrary, the quick activation can be achieved by promoting the rise of the element temperature (large initial value) when the element temperature is high and the water content in the exhaust is unlikely to be condensed. Reexamination of the initial value constant caused by variations in components is not required and adaptation for each engine type is not necessary or is reduced by a large margin.

Further, according to the invention, an element temperature of a sensor element of an air-fuel ratio sensor is detected by measuring an impedance of the sensor element, an increase component of power supply amount to a heater is set corresponding to the detected element temperature, and the power supply amount to heater is feedforward controlled so that the power supply amount to the heater is increased gradually by each increase component from a predetermined initial value.

Here, the increase component of the power supply amount to the heater is set smaller as the element temperature is lower.

According to this construction, when the power supply amount to the heater is feedforward controlled so that the power supply amount to the heater is increased gradually by each predetermined increase component from the predetermined initial value, the element temperature is accurately detected by measuring the impedance of the sensor element of air-fuel ratio sensor, and the increase component of the power supply amount to the heater is set corresponding to the detected element temperature. Thus, an element crack due to the exhaust condensed water can certainly be avoided by delaying the rise of the element temperature (small increase component) when the element temperature is low and the water content in the exhaust is likely to be condensed. On the contrary, the quick activation can be achieved by promoting the rise of the element temperature (large increase component) when the element temperature is high and the water content in the exhaust is unlikely to be condensed. Simplification of the control can be made by the use of feedforward control.

The other objects and features of this invention will become understood from the following description with reference to the accompanying drawings.

EMBODIMENT

Embodiments according to the present invention will be explained as follows.

Figure 1:
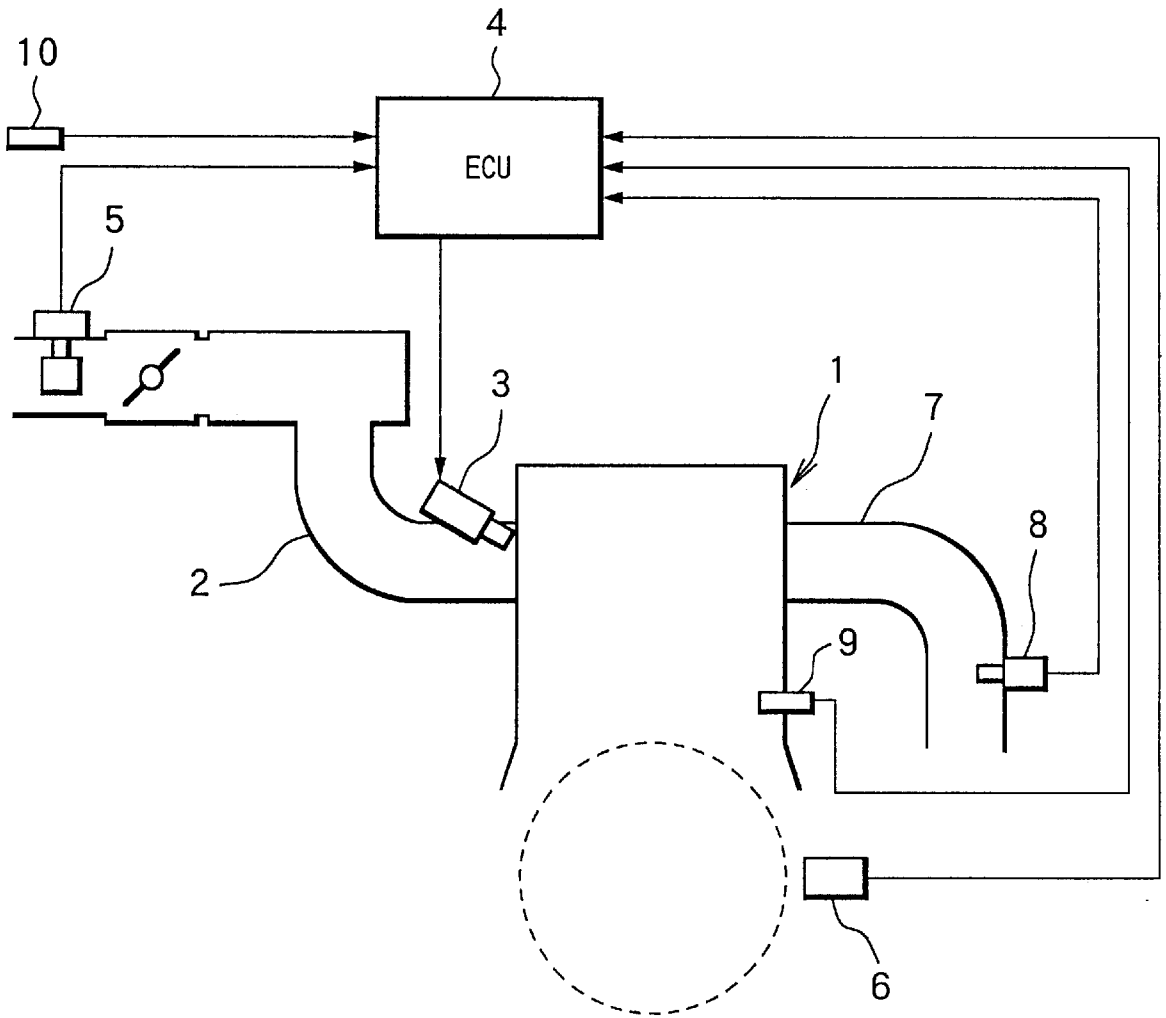
FIG. 1 is a system diagram of an air-fuel ratio feedback control apparatus for an internal combustion engine showing an embodiment according to the present invention.

FIG. 1 is a system diagram of an air-fuel ratio feedback control apparatus in an internal combustion engine.

A fuel injection valve 3 is disposed for each cylinder in an internal combustion engine 1, so as to face an intake passage 2 or a combustion chamber. Fuel injection from each fuel injection valve 3 is controlled by an engine control unit 4 (to be referred as ECU hereinafter) installing a microcomputer therein.

The ECU 4 computes a basic fuel injection quantity $Tp=K\times Qa/Ne$ (K is constant) equivalent to a stoichiometric amount of air ($\lambda=1$) based on an intake air quantity Qa to be detected based on a signal from an air flow meter 5 and an engine rotation speed Ne to be detected based on a signal from a crank angle sensor 6, corrects this basic fuel injection quantity by an air-fuel ratio feedback correction coefficient $\alpha$ to be set based on a signal from an air-fuel ratio sensor 8 disposed in an exhaust passage 7 in addition to a target air-fuel ratio $t\lambda$, to compute a final fuel injection quantity $Ti=Tp\times(1/t\lambda)\times\alpha$, and outputs a fuel injection pulse having a pulse width corresponding to the Ti to each fuel injection valve 3 in synchronization with the engine rotation.

For various controls, the ECU 4 receives a signal from a water temperature sensor 9 facing inside of a water jacket of the engine 1 to detect an engine cooling water temperature Tw, and in case where an atmospheric temperature sensor 10 is disposed in front of a radiator of a vehicle to detect the atmospheric temperature Ta, receives a signal from the atmospheric temperature sensor 10.

Here, the air-fuel ratio sensor 8 is disposed in the exhaust passage 7 to output a signal corresponding to an oxygen concentration in the exhaust. The ECU unit 4 detects an air-fuel ratio $\lambda$ of an air-fuel mixture being supplied to the engine 1 based on the signal from the air-fuel ratio sensor 8, and increasingly/decreasingly sets the air-fuel ratio feedback correction coefficient $\alpha$ by a PID control to feedback control the air-fuel ratio $\lambda$ to the target air-fuel ratio $t\lambda$, so that the detected air-fuel ratio $\lambda$ reaches the target air-fuel ratio $t\lambda$.

For the air-fuel ratio sensor 8, there is used a wide range type air-fuel ratio sensor capable of linearly detecting the air-fuel ratio.

Figure 2:
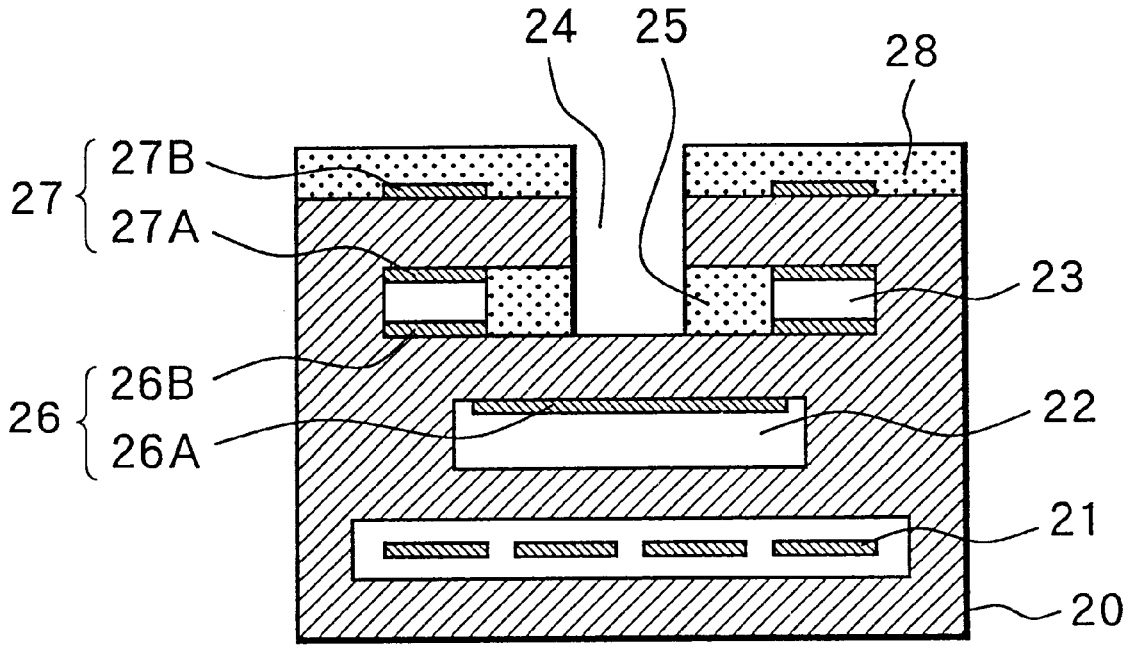
FIG. 2 is a diagram showing a sensor element structure of an air-fuel ratio sensor.

A sensor element structure of the wide range type air-fuel ratio sensor 8 is shown in FIG. 2 and the explanation thereof will be made herein.

A body 20 of the sensor element is formed with a solid electrolyte material such as a zilconia having the oxygen ion conductivity into a porous layer and disposed in the exhaust passage.

Inside of the body 20, a heater 21, an air chamber 22, and a gas diffusion chamber 23 are equipped from the bottom in FIG. 2.

The heater 21 can heat a sensor element by the power supply thereto.

The air chamber 22 is formed so as to communicate with air as a standard gas outside the exhaust passage.

The gas diffusion chamber 23 is formed so as to communicate with the exhaust, through a protection layer 25 made of a γ aluminum and the like, by an exhaust gas introduction hole 24 formed from an upper face side of the body 20 in FIG. 2.

An electrode 26A disposed on an upper wall of the air chamber 22 and an electrode 26B disposed on a bottom wall of the gas diffusion chamber 23 constitutes a nernst cell portion 26.

An electrode 27A disposed at an upper wall of the gas diffusion chamber 23, and an electrode 27B disposed at an upper wall of the body 20 and covered with a protection layer 28 constitute a pump cell portion 27.

The nernst cell portion 26 generates a voltage corresponding to an oxygen partial pressure ratio between the nernst cell portion electrodes 26A, 26B to be influenced by an oxygen ion concentration (oxygen partial pressure) within the gas diffusion chamber 23.

Accordingly, it can be detected whether or nor the air-fuel ratio is richer or leaner than the stoichiometric amount of air ($\lambda$=1) by detecting the voltage generated due to the oxygen partial pressure ratio between the nernst cell portion electrodes 26A, 26B.

When a predetermined voltage is applied to the pump cell portion 27, an oxygen ion in the gas diffusion chamber 23 moves so that a current flows between the pump cell portion electrodes 27A and 27B.

Then, when the predetermined voltage is applied between the pump cell portion electrodes 27A and 27B, a current value (limit current value) Ip flowing between these electrodes is affected by the oxygen ion concentration in the gas diffusion chamber 23. Therefore, if the current value Ip is detected, the air-fuel ratio of the exhaust can be detected.

Figure 3A:
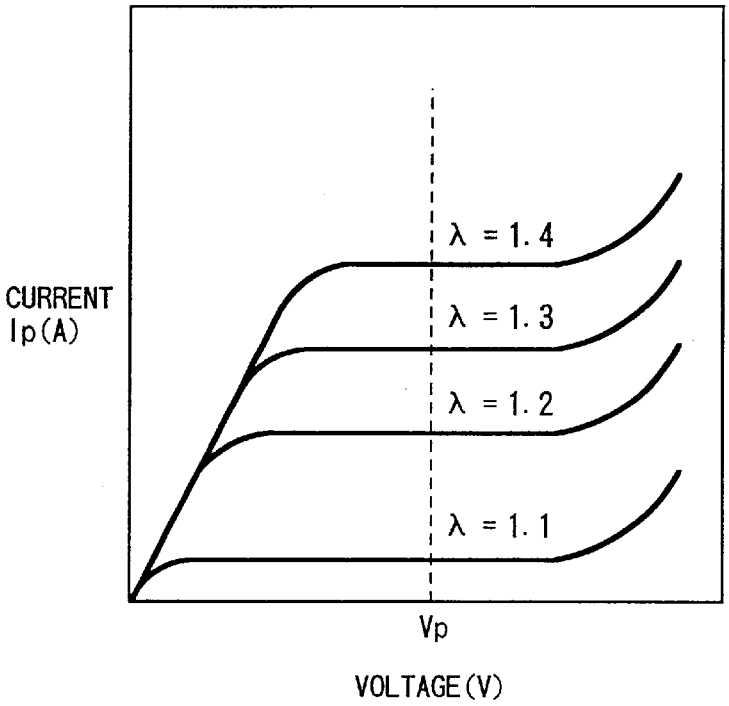
FIG. 3 is a characteristic diagram of a sensor element of the air-fuel ratio sensor.

Namely, as shown in FIG. 3A, a voltage-current characteristic of the pump cell portion 27 is varied depending on the air-fuel ratio $\lambda$, and the air-fuel ratio $\lambda$ of the exhaust can be detected based on the current value Ip when a predetermined voltage Vp is applied.

Figure 3B:
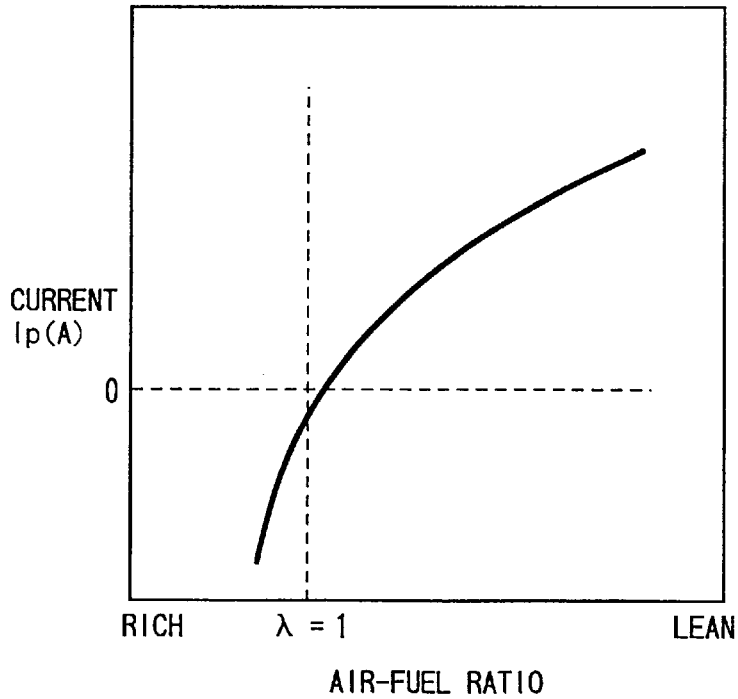

When an application direction of the voltage to the pump cell portion 27 is reversed based on an output of lean or rich at the nernst cell portion 26, in both of a lean air-fuel ratio region a rich air-fuel ratio region, as shown in FIG. 3B, the air-fuel ratio $\lambda$ can be detected in a wide range based on the current value Ip flowing in the pump cell portion 27.

According to the present invention, for the purpose of the power supply control to the heater 21, an impedance of the sensor element with the above described structure and characteristic is measured by applying an alternating voltage with a high frequency to the sensor element (especially the nernst cell portion 26) to detect a temperature of the sensor element.

Figure 4:
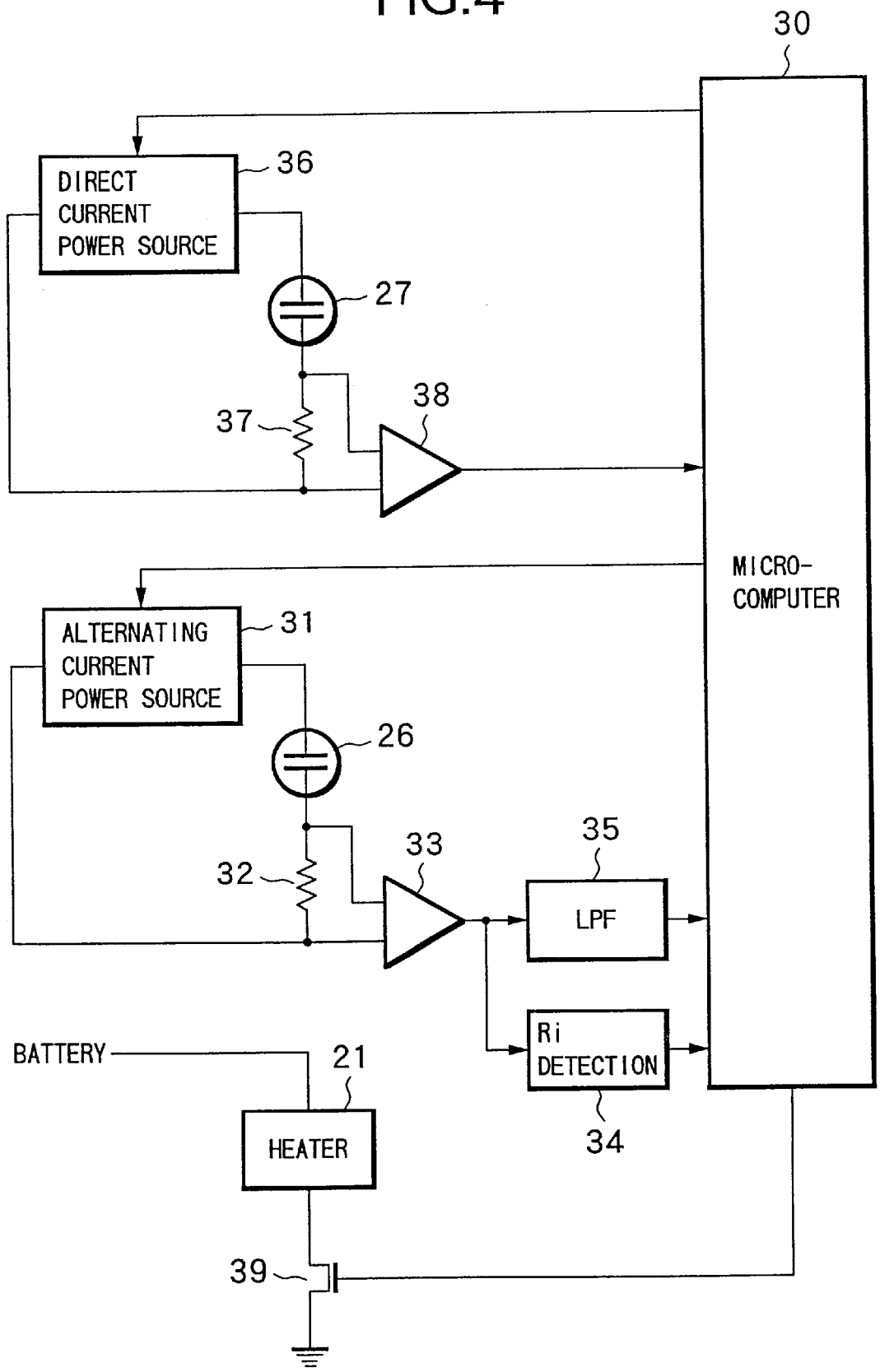
FIG. 4 is a control circuit diagram for the sensor element and a heater of the air-fuel ratio sensor.

FIG. 4 shows a control circuit the sensor element (nernst cell portion and pump cell portion) of the air-fuel ratio sensor and for the heater for heating the sensor element.

An alternating voltage with a high frequency (frequency number f=3 KHz, amplitude 1.75V) is applied to the nernst cell portion 26 by an alternating current source 31 under the control of a microcomputer 30 for the purpose of detection of the impedance, so that a current value is flowing in the nernst cell portion 26 is voltage transformed by a current detection resistor 32 and a detection amplifier 33.

A signal from the detection amplifier 33 is input to an impedance detection circuit 34 comprising a high pass filter and an integrator, wherein an alternating current component only is taken out to detect an impedance Ri from the amplitude of the alternating current component. Thus, it can be detected the impedance Ri of the nernst cell portion 26, correlating with the sensor element temperature.

The signal from the detection amplifier 33 is input to a low pass filter 35, wherein a direct current component only is taken out and a voltage generated at the nernst cell portion 26 corresponding to the oxygen concentration is detected. Thus, the lean or rich of the oxygen concentration can be detected.

A predetermined voltage Vp is applied to the pump cell portion 27 by a direct current source 36 under the control of the microcomputer 30 and its application direction is reversed corresponding to the lean or rich of the oxygen concentration to be detected at the nernst cell portion 26, so that the current Ip flowing in the pump cell portion 27 is voltage transformed and detected by a current detection resistor 37 and a detection amplifier 38. Thus, the air-fuel ratio $\lambda$ can be detected.

A battery voltage VB is applied to the heater 21 by a battery, and a switching element 39 is disposed in a power supply circuit. Accordingly, The ON/OFF of the switching element 39 is duty-controlled by the microcomputer 30, so that a power supply amount to the heater 21 can be controlled. Therefore, hereinafter, the power supply amount to the heater 21 is shown by duty DUTY (%; in case the power supply amount is controlled by a pulse width of a pulse signal supplied at a predetermined cycle period time, percentage of the pulse width to the cycle period).

A heater control by the microcomputer 30 will be explained with reference to the flowchart.

Figure 5:
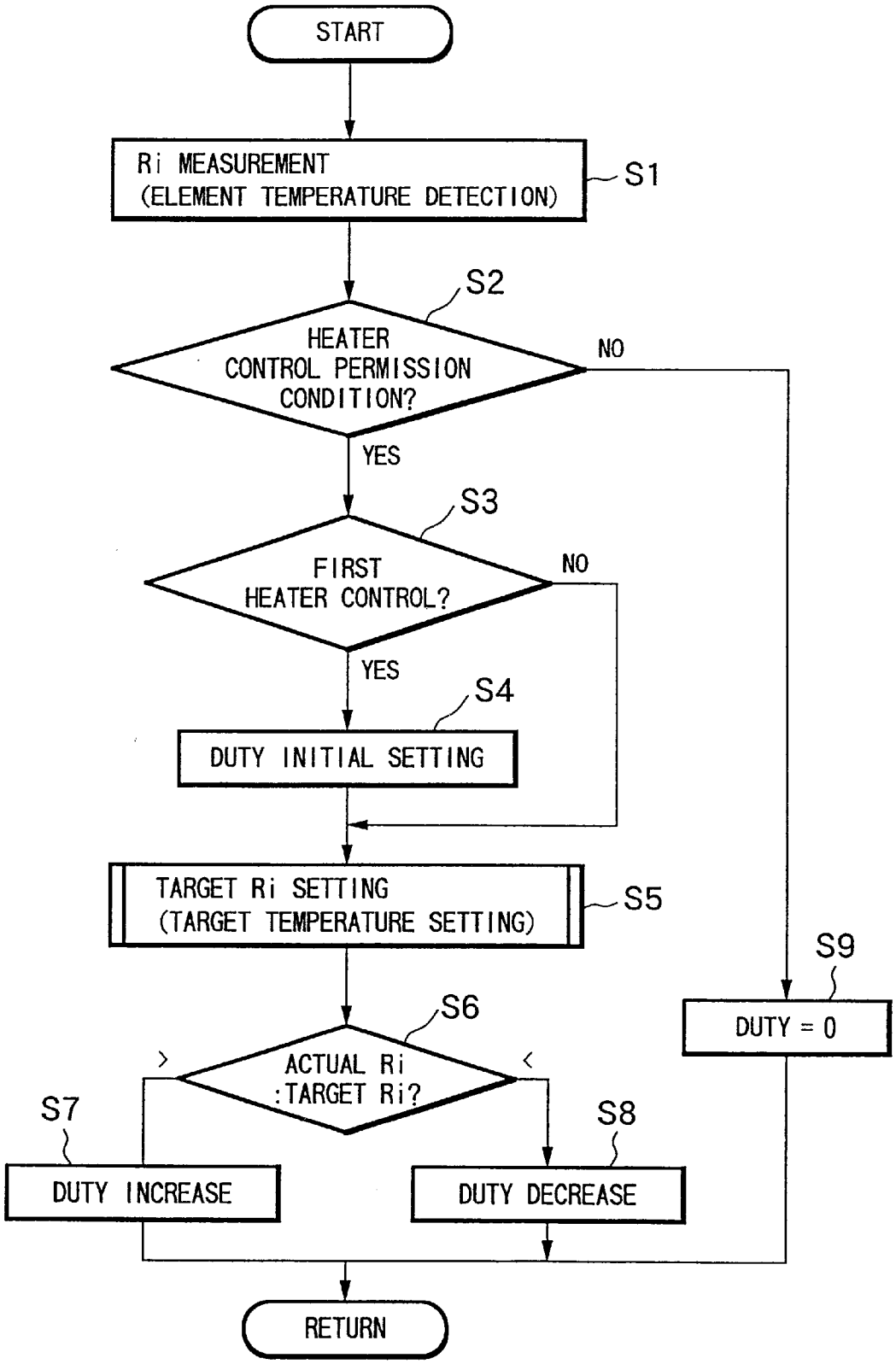
FIG. 5 is a flowchart of a heater control routine in a first embodiment.

FIG. 5 is a flowchart of the heater control in a first embodiment, which is executed for each predetermined time.

At Step 1 (abbreviated as "S1" in the drawing, the same holds hereinafter), in a state where the alternating current source 31 is turned ON to apply the alternating voltage with high frequency (for example, frequency f=3 KHz, amplitude 1.75V) to the nernst cell portion 26, the impedance Ri of the nernst cell portion 26 is measured based on the current value (amplitude) flowing in the nernst cell portion 26 due to the application of alternating voltage through the impedance detection circuit 34 and the like. This impedance Ri correlates with the element temperature of the air-fuel ratio sensor, which becomes larger as the element temperature is lower and becomes smaller as the element temperature is higher. Accordingly, this step corresponds to an element temperature detection unit by the impedance measurement.

At Step 2, it is judged whether or not a predetermined heater control permission condition is established. Here, a heater control permission condition means, for example, a situation where the engine is under the rotation, the battery voltage is a predetermined value or above, and it is diagnosed that the air-fuel ratio sensor and the heater thereof are not failed.

If the heater control permission condition is established, the procedure goes to Step 3.

At Step 3, it is judged whether or not it is a first time of heater control (a heater control start time including restart of the heater control). If it is the first time of heater control, the procedure goes to Step 4, wherein a heater duty DUTY is set initially. The heater duty DUTY is set to a previously determined initial value or is set to an initial value in accordance with a subroutine in FIG. 8 as shown in a second embodiment to be described later.

After the heater duty DUTY is set initially or in case it is not the first time of heater control, the procedure goes to Step 5.

Figure 6:
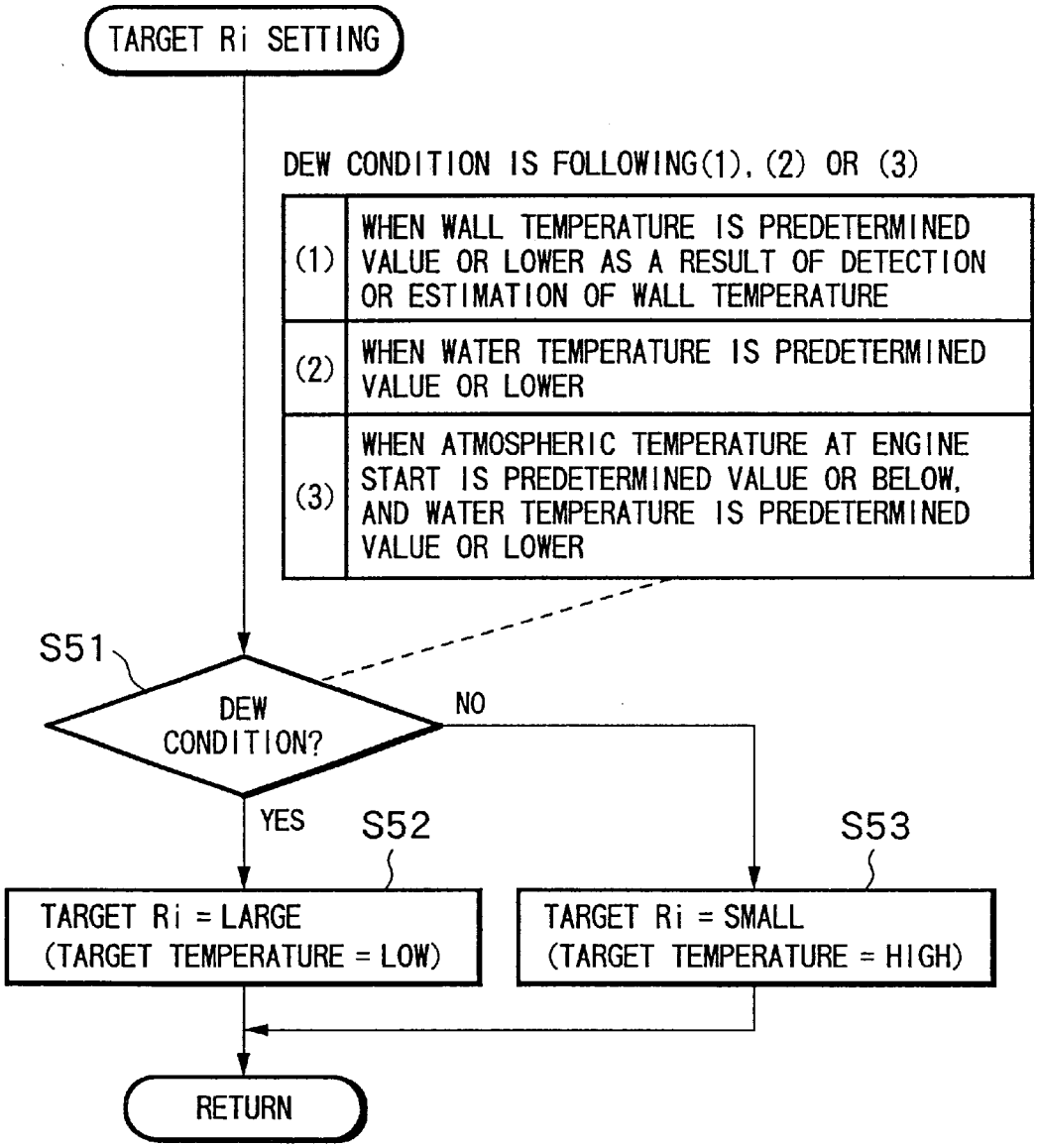
FIG. 6 is a flowchart of a subroutine of target impedance setting in the first embodiment.

At Step 5, a target impedance (target Ri) corresponding to a target temperature of the sensor element is set in accordance with a subroutine in FIG. 6 to be described later. This step corresponds to a target temperature setting unit including a heater control amount restraining unit.

At Step 6, the measured impedance (actual Ri) and the target impedance (target Ri) are compared with each other, and based on the comparison result, the procedure goes to Step 7 or Step 8, wherein the heater duty DUTY is increased or decreased from the initial value (a previous value after a second time) by the PI control or the PID control so that the actual Ri coincides the target Ri.

Since the element temperature is low and the actual Ri is larger than the target Ri immediately after the engine start, the heater duty DUTY is gradually increased from the initial value for the element temperature to rise up to the target temperature.

By such a heater duty control at Steps 6 to 8, the impedance Ri of the sensor element is feedback controlled to the target Ri so that the element temperature can be feedback controlled to the target temperature. These steps correspond to a heater power supply amount feedback control unit.

On the other hand, if the heater control permission condition is not established in the judgement of Step 2, the procedure goes to Step 9, wherein the routine is terminated as the heater duty DUTY=0. Accordingly, in this case, the power supply to the heater 21 is not made.

The target impedance setting (target temperature setting) by the subroutine in FIG. 6 will be explained. This subroutine corresponds to a target temperature setting unit including a heater control amount restraining unit.

At Step 51, it is judged whether or not a condensation condition for a water content in the exhaust to become dew in an exhaust system is established.

The judgment as to whether or not it is the condensation condition depends on the following (1), (2), or (3).

(1) A wall temperature of the exhaust passage 7 in the engine 1 is detected or estimated, and when the wall temperature thereof is a predetermined value (for example, 60° C.) or less, it is regarded that the condensation condition is established. This is because it is preferable to detect the wall temperature since whether or not the condensation occurs depends on the wall temperature. However, in a case where the provision of a wall temperature sensor as wall temperature means results in cost-up, the wall temperature is estimated from an engine operating condition as an indirect detection. Specifically, there can be a method to estimate the wall temperature from the engine cooling water temperature at the engine start and a receiving heat amount based on an integrated value of the intake air quantity after the engine start.

(2) Simply, the engine cooling water temperature Tw is detected by the water temperature sensor 9, and when the water temperature Tw is a predetermined value or lower, it is regarded that the condensation condition is established. This is because the engine cooling water temperature Tw highly correlates with the wall temperature.

(3) In a case where the atmospheric temperature sensor 10 is provided, the atmospheric temperature Ta and the engine cooling water temperature Tw are used, and on a precondition that the atmospheric temperature Ta at the engine start is a predetermined value or lower, it is regarded that the condensation condition is established when the water temperature Tw is a predetermined value or lower. This is because, by taking into consideration the atmospheric temperature Ta at the engine start, the condensation condition can be judged more accurately.

In a case where the condensation condition is established, the procedure goes to Step 52, wherein the target impedance (target Ri) is set to a large value (for example, 1 kΩ) equivalent to a lower side target temperature (for example, 350° C.).

In a case where the condensation condition is not established, the procedure goes to Step 53, wherein the target impedance (target Ri) is set to a small value (for example, 100 Ω) equivalent to a higher side target temperature (for example, 800° C.).

According to such a target temperature setting, if there is a possibility of occurrence of condensed water immediately after the engine start at a cold time or the like, the element temperature is controlled to be maintained at less than a predetermined temperature (for example, 350° C.) so as to prevent the element crack. If there is no possibility of occurrence of condensed water or there has been no possibility thereof, the target temperature is set at a higher side so as to perform the quick activation.

Although the explanation is omitted in the embodiment, in the process wherein the impedance Ri of the sensor element is converged into the target Ri equivalent to the higher side target temperature, when the impedance Ri becomes equal to or less than a predetermined value equivalent to the active temperature (for example, 750° C.) of the sensor element, an activation judgment (setting a flag of the activation judgment) is carried out. Thereby, the air-fuel ratio feedback control is started based on the signal from the air-fuel ratio sensor.

In the present embodiment, the target temperature is switched in two stages. However, the susceptibility to concentration may be judged so that the target temperature is switched in multiple stage (three stages or more) based on the judgment result.

Another embodiment according to the present invention will be explained next.

Figure 7:
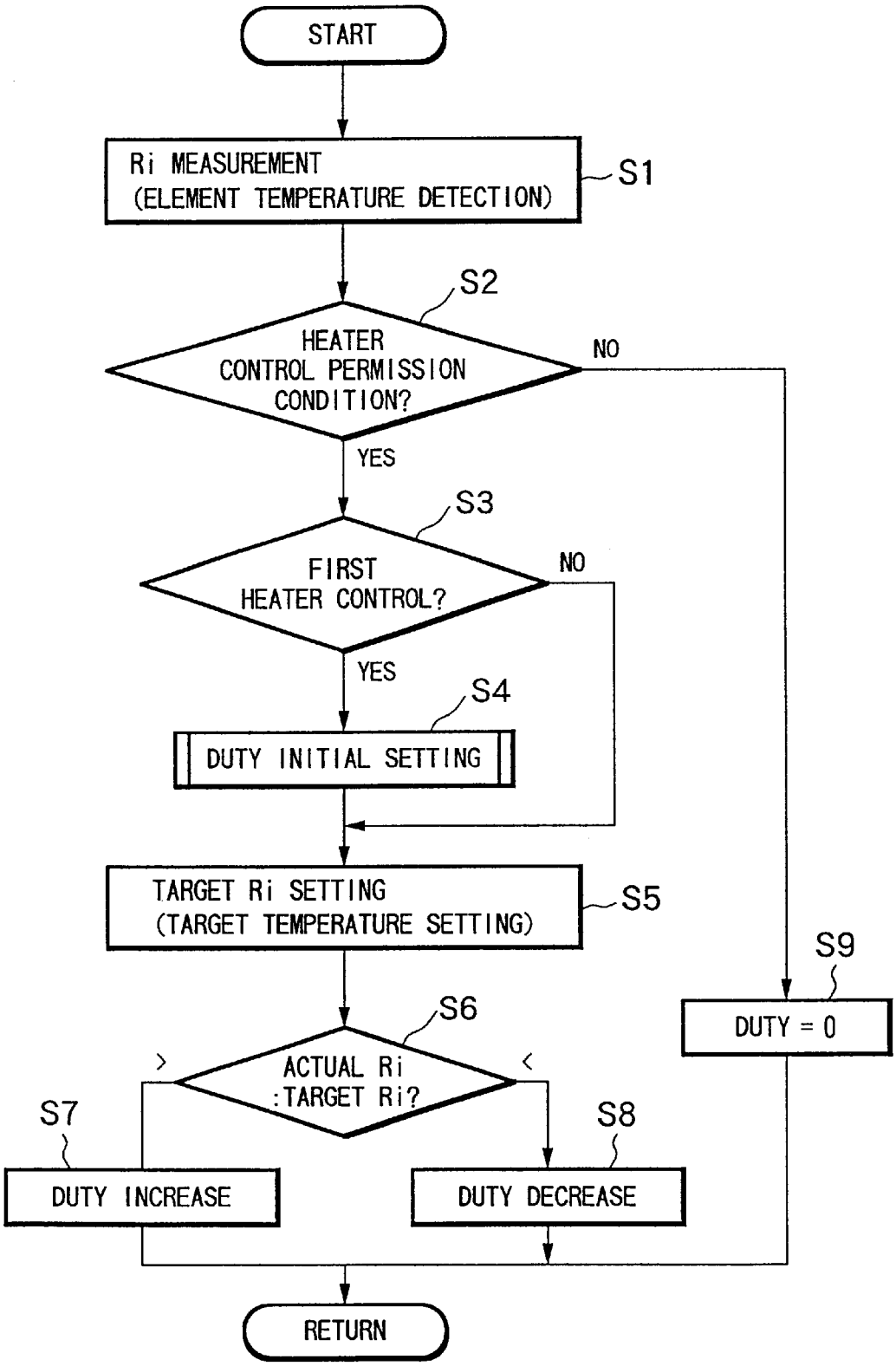
FIG. 7 is a flowchart of a heater control routine in a second embodiment.

FIG. 7 is a flowchart of a heater control in a second embodiment, which is executed instead of the flowchart in FIG. 5.

Figure 8:
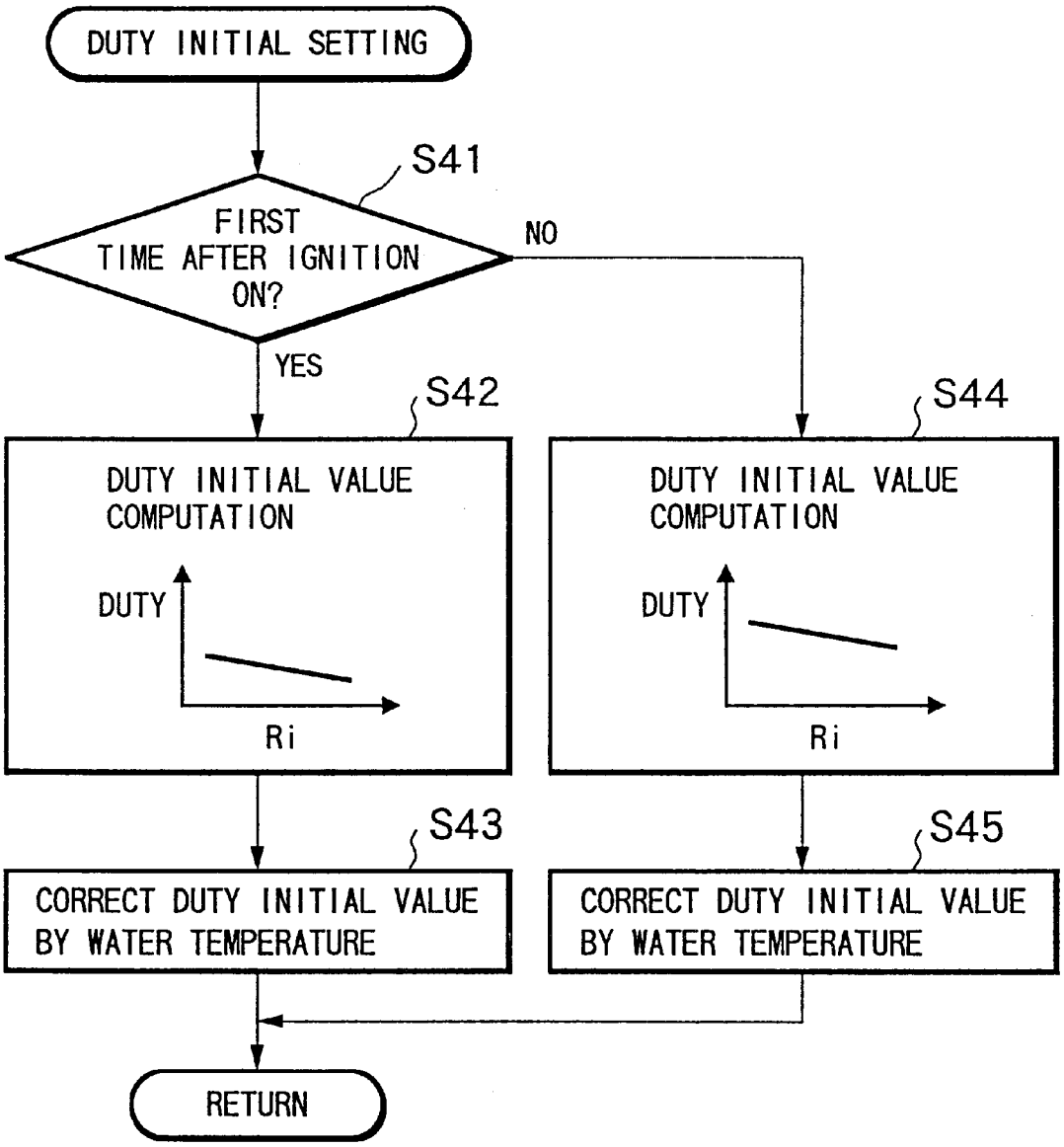
FIG. 8 is a flowchart of a subroutine of initial duty setting in the second embodiment.

In the second embodiment, the initial setting of heater duty DUTY at Step 4 is carried out according to the subroutine in FIG. 8.

In this case, in the target impedance setting (target temperature setting) at Step 5, the heater duty DUTY may be set to a previously determined target Ri or may be set according to the subroutine in FIG. 7 as described in the first embodiment.

The initial setting of heater duty in the subroutine in FIG. 8 will be explained. This subroutine corresponds to a power supply amount initial setting unit.

At Step 41, it is judged whether or not the heater control is the first time after an ignition (IGN) is switched ON. This judgment is for determining if the heater control is of the heater control start time immediately after the engine start or of the heater control restart time during the engine operation.

If it is the first time after the ignition is switched ON (in a case where the heater control start time immediately after the engine start), the procedure goes to Steps 42 and 43.

At Step 42, the initial value of the heater duty DUTY is set corresponding to the impedance Ri of the sensor element having been measured at this time (equivalent to the element temperature before the start of power supply to the heater), by referring to a table. Here, as the impedance Ri before the start of power supply is larger, the condensation is more likely to occur. Therefore, the initial value of the heater duty DUTY is set smaller so as to delay the temperature rise.

At Step 43, if necessary, the initial value of the heater duty DUTY is corrected with the water temperature Tw. To be specific, the condition is such that as the water temperature Tw is lower, the condensation is more likely to occur. Therefore, the initial value of the heater duty DUTY is corrected to the smaller side.

If the heater control is not the first time after the ignition is switched ON (in a case where the heater control restart time during the engine operation), the procedure goes to Steps 44 and 45.

At Steps 44 and 45, the same process at Steps 42 and 43 is carried out. Since the condensation is unlikely to occur in a case of the heater control restart time during the engine operation, the initial value of the heater duty DUTY in the table to be referred at Step 44 is set relatively large (the same manner applied to the correction at Step 45).

In imaginary, in a case of the heater control start time immediately after the engine start, when the element temperature before the power supply start is low and the impedance is large (for example, 10 kΩ or more), the initial value of the heater duty DUTY is set to about 30%, while when the element temperature before the power supply start is high and the impedance is small (for example, about 300 Ω), the initial value of the heater duty DUTY is set to about 50%.

In a case of the heater control restart time during the engine operation, when the element temperature before the power supply start is low and the impedance is large (for example, 10 kΩ or more), the initial vale of the heater duty DUTY is set to about 60%, while when the element temperature is high and the impedance is small (for example, about 300 Ω), the initial value of the heater duty DUTY is set to about 80%.

By such an initial value setting of the heater duty DUTY, when the impedance of the sensor element before the power supply start to the heater is larger, the element temperature is lower, and the water temperature Tw is lower and further, at the heater control start time immediately after the engine start, the condensation is more likely to occur. Therefore, the initial value of the heater duty DUTY is made small to delay the rise of the element temperature so that the element crack is prevented. On the contrary, as the condensation is more unlikely to occur, the initial value of the heater duty DUTY is made large to promote the rise of the element temperature so that the quick activation is performed.

Figure 9:
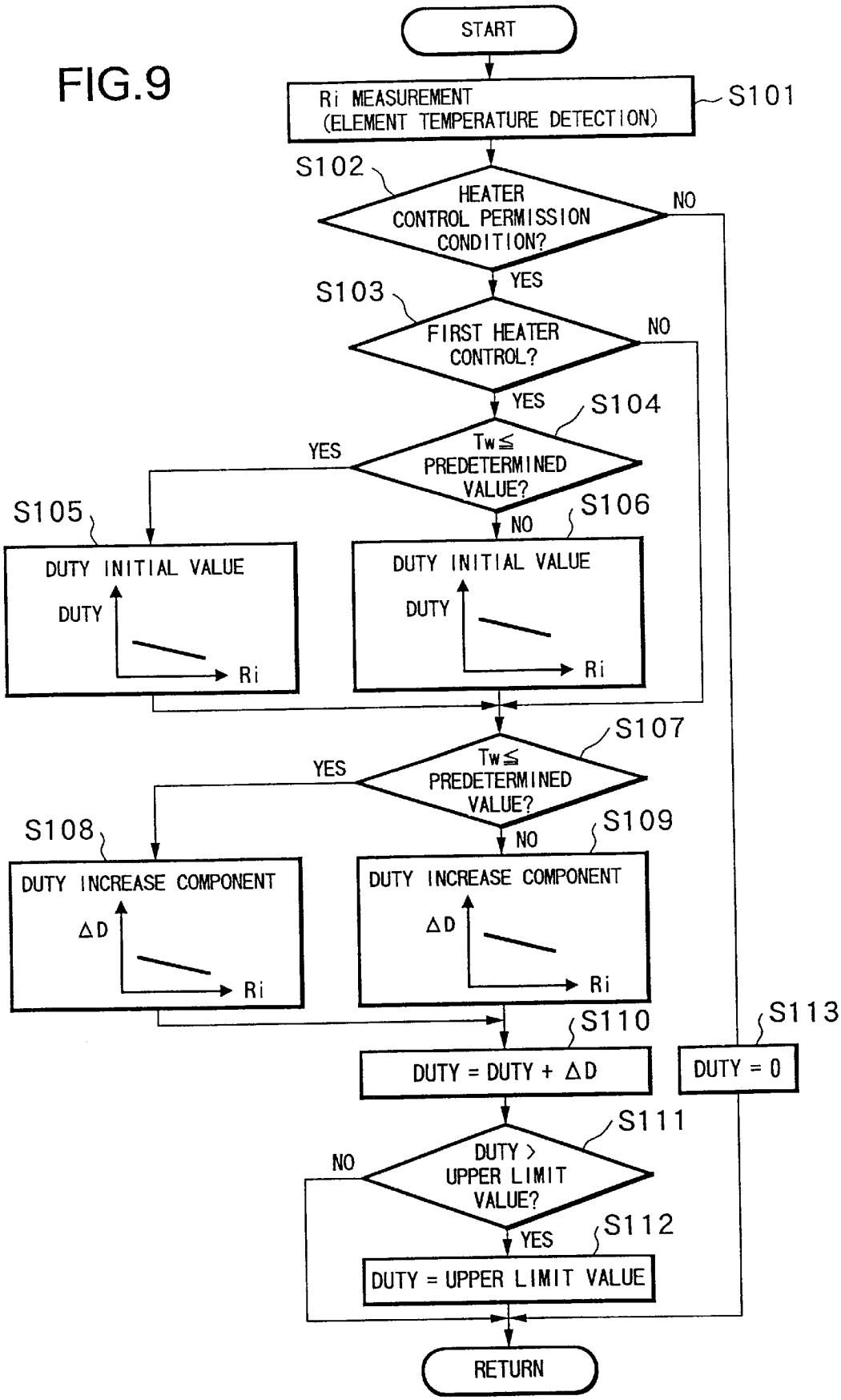
FIG. 9 is a flowchart of a heater control routine in a third embodiment.

FIG. 9 is a flowchart of a heater control in a third embodiment, which is executed instead of the flowchart in FIG. 5 or 7.

At step 101, similar to Step 1 described before, the impedance Ri of the sensor element correlating with the element temperature of the air-fuel ratio sensor is measured. This step corresponds to an element temperature detection unit by impedance measurement.

At Step 102, similar to Step 2 described before, it is judged whether or not a predetermined heater control permission condition is established.

If the heater control permission condition is established, the procedure goes to step 103.

At Step 103, it is judged whether or not the heater control is the first time (the heater control start time including restart time). If the heater control is the first time, the procedure goes to Step 105 or 106 through Step 104, wherein the initial value of the heater duty DUTY is set corresponding to the impedance Ri of the sensor element having been measured at this time (equivalent to the element temperature before the power supply start to the heater) by referring to a table. This step corresponds to an power supply amount initial value setting unit.

Here, as the impedance Ri before the power supply start is larger (the element temperature before the power supply start is lower), the condensation is more likely to occur. Therefore, the initial value of the heater duty DUTY is set as small so as to delay the temperature rise.

However, at the previous Step 104, it is judged whether or not the water temperature Tw at the engine start (the water temperature Tw is adopted as a parameter correlating with the wall temperature of the exhaust system, so the wall temperature may be detected directly) is a predetermined value or lower. When Tw≦the predetermined value, the condensation is likely to occur. Therefore, at Step 105, the initial value of the heater duty DUTY is set a lower side. When Tw>the predetermined value, the initial value of the heater duty DUTY is set relatively high using another table at Step 106.

In imaginary, in a case Tw≦the predetermined value, when the element temperature before the power supply start is low and the impedance is large (for example, 10 kΩ or more) the initial value of the heater duty DUTY is set to about 30%, while when the element temperature before the power supply start is high and the impedance is small (for example, about 300 Ω), the initial value of the heater duty is set to about 50%.

After the initial value of the heater duty DUTY is set, or when the heater control is not the first time, the procedure goes to Step 108 or 109 through Step 107.

At Step 108 or Step 109, an increase component ΔD of the heater duty DUTY is set corresponding to the impedance Ri of the sensor element having been measured at this time (equivalent to the present element temperature) by referring to a table. This step corresponds to a power supply amount increase component setting unit.

Here, as the impedance Ri is larger (the element temperature is lower), the condensation is more likely to occur. Therefore, the increase component ΔD of the heater duty DUTY is set small so as to delay the temperature rise.

However, at the previous Step 107, it is judged whether or not the water temperature Tw (the water temperature Tw is adopted as a parameter correlating with the wall temperature of the exhaust system, so the wall temperature may be detected directly) is a predetermined value or lower. When Tw≦the predetermined value, the condensation is likely to occur. Therefore, at Step 108, the increase component ΔD of the heater duty DUTY is set relatively small. When Tw>the predetermined value, the increase component ΔD of the heater duty DUTY is set relatively large using another table at Step 109.

In imaginary, in a case Tw≦the predetermined value, when the element temperature is low and the impedance is large (for example, 10 kΩ or more), the increase component ΔD of the heater duty DUTY is set to about 0.5%, while when the element temperature is high and the impedance is small (for example, about 300 Ω), the increase component ΔD of the heater duty DUTY is set to about 2%.

At Step 110, the heater duty DUTY is updated by adding the increase component ΔD to the initial value of the heater duty DUTY (the previous value at the second time or thereafter) as the following equation.

$$DUTY=DUTY+\Delta D$$

This step corresponds to a heater power supply amount feedforward control unit.

At Step 111, the updated heater duty DUTY is compared with a predetermined upper limit value. When DUTY≦the upper limit value, the updated duty DUTY is output without any change, while when DUTY>the upper limit value, at Step 112 the heater duty DUTY is controlled to the upper limit value, to be output.

On the other hand, in a case where, at Step 102, it is judged that the heater control permission condition is not established, the procedure goes to Step 113, wherein the heater duty DUTY=0 and this routine is terminated. Accordingly, the power supply to the heater 21 is not made.

As described above, when the feedforward control is performed in a way that the heater duty DUTY is gradually increased from a predetermined initial value by adding each predetermined increase component ΔD, as the impedance of the sensor element is larger and the element temperature is lower, the condensation is more likely to occur. Therefore, the initial value of the heater duty DUTY and the increase component ΔD are made small to delay the rise of the element temperature so that the element crack is prevented. When the condensation is unlikely to occur, the initial value of the heater duty DUTY and the increase component ΔD are made large to promote the rise of the element temperature so that the quick activation is promoted.

As described above, according to the present invention, when performing the heater control of air-fuel ratio sensor, the element crack due to the condensed water in the exhaust is certainly avoided and therefore the applicability of the present invention to an industry is large.

The entire contents of Japanese Patent Application No. 2000-187673, filed Jun. 22, 2000, are incorporated herein by reference.

What is claimed:

1. A heater control apparatus of an air-fuel ratio sensor which is mounted to an exhaust system of an internal combustion engine and equipped with a heater for heating a sensor element comprising:

an element temperature detection unit for detecting an element temperature by measuring an impedance of the sensor element of said air-fuel ratio sensor;

a target temperature setting unit for setting a target temperature of the element temperature;

a heater power supply amount feedback control unit for feedback controlling a power supply amount to said heater so that the element temperature reaches said target temperature; and a heater control amount restraining unit for restraining at least one of said target temperature of the element temperature and the power supply amount to said heater to a lower temperature side, compared to other conditions, on a condition that a water content in the exhaust is condensed in an exhaust system.

2. A heater control apparatus of an air-fuel ratio sensor according to claim 1, wherein said heater control amount restraining unit is equipped with a unit for directly or indirectly detecting a wall temperature in the exhaust system, and when the wall temperature is a predetermined value or lower, it is regarded the condition that the water content in the exhaust is condensed in the exhaust system.

3. A heater control apparatus of an air-fuel ratio sensor according to claim 1, wherein said heater control amount restraining unit is equipped with a unit for detecting an engine cooling water temperature, and when the water temperature is a predetermined value or lower, it is regarded the condition that the water content in the exhaust is condensed in the exhaust system.

4. A heater control apparatus of an air-fuel ratio sensor according to claim 1, wherein said heater control amount restraining unit is equipped with a unit for detecting an atmospheric temperature and a unit for detecting an engine cooling water temperature, and on a condition that the atmospheric temperature at an engine start time is a predetermined value or lower, when the water temperature is a predetermined value or lower, it is regarded the condition that the water content in the exhaust is condensed in the exhaust system.

5. A heater control apparatus of an air-fuel ratio sensor according to claim 1, wherein said heater control amount restraining unit is equipped with a power supply amount initial setting unit for setting an initial value of the power supply amount to said heater corresponding to the element temperature before the start of power supply to said heater, and sets the power supply amount to said heater to said initial value when the power supply to said heater is started, and sets the power supply amount to said heater after starting the power supply to said heater so that the element temperature reaches a predetermined target temperature.

6. A heater control apparatus of an air-fuel ratio sensor according to claim 5, wherein said power supply amount initial setting unit sets the initial value of the power supply amount to said heater to be smaller as the element temperature before the start of power supply to said heater is lower.

7. A heater control apparatus of an air-fuel ratio sensor according to claim 5, wherein said power supply amount initial setting unit is equipped with a unit for detecting an engine cooling water temperature, and corrects the initial value of the power supply amount to said heater corresponding to the element temperature before the start of power supply to said heater, in accordance with the water temperature.

8. A heater control apparatus of an air-fuel ratio sensor according to claim 5, wherein said power supply amount initial setting unit is equipped with means for judging whether it is a time of the start of power supply to said heater immediately after the engine start or it is a time of the restart of power supply to said heater during an engine operation, and sets the initial value of the power supply amount to said heater corresponding to the element temperature before the start of power supply to said heater, to different values in accordance with the judgment result.

9. A heater control apparatus of an air-fuel ratio sensor which is mounted to an exhaust system of an internal combustion engine and equipped with a heater for heating a sensor element comprising:

an element temperature detection unit for detecting an element temperature by measuring an impedance of the sensor element of said air-fuel ratio sensor;

a power supply amount increase component setting unit for setting an increase component of a power supply amount to said heater corresponding to the detected element temperature; and a heater power supply amount feedforward control unit for controlling the power supply amount to said heater to be increased gradually by each increase component from a predetermined initial value.

10. A heater control apparatus of an air-fuel ratio sensor according to claim 9, wherein said power supply amount increase component setting unit sets the increase component of the power supply amount to said heater to be smaller as the element temperature is lower.

11. A heater control apparatus of an air-fuel ratio sensor according to claim 9, wherein said power supply amount increase component setting unit sets the increase component of the power supply amount to said heater to be smaller, compared to other conditions, on a condition that a water temperature in an exhaust system is a predetermined value or lower.

12. A heater control apparatus of an air-fuel ratio sensor according to claim 9, further comprising a power supply amount initial setting unit for setting an initial value of the power supply amount to said heater corresponding to the element temperature before the start of power supply to said heater.

13. A heater control apparatus of an air-fuel ratio sensor according to claim 12, wherein said power supply amount initial setting unit sets the initial value of the power supply amount to said heater to be smaller as the element temperature before the start of power supply to said heater is lower.

14. A heater control apparatus of an air-fuel ratio sensor according to claim 12, wherein said power supply amount initial setting unit sets the initial value of the power supply amount to said heater to be smaller, compared to other conditions, on a condition that a water temperature in an exhaust system is a predetermined value or lower.

15. A heater control apparatus of an air-fuel ratio sensor according to claim 1, wherein said air-fuel ratio sensor comprises a nernst cell portion for generating a voltage corresponding to the lean or rich of an air-fuel ratio and a pump cell portion which is applied with a predetermined voltage in a direction corresponding to the lean or rich of the air-fuel ratio detected by said nernst cell portion to continuously vary a current value thereof corresponding to the air-fuel ratio, and said element temperature detection unit applies an alternating voltage to said nernst cell portion to measure an impedance of said nernst cell portion based on the current value flowing in said nernst cell portion.

16. A heater control method of an air-fuel ratio sensor which is mounted to an exhaust system of an internal combustion engine and equipped with a heater for heating a sensor element, wherein an element temperature is detected by measuring an impedance of the sensor element of said air-fuel ratio sensor, a power supply amount to said heater is feedback controlled so that the element temperature reaches a set target temperature, and at least one of said target temperature of the element temperature and the power supply amount to said heater is restrained to a lower temperature side, compared to other conditions, on a condition that a water content in the exhaust is condensed in an exhaust system.

17. A heater control method of an air-fuel ratio sensor according to claim 16, wherein a wall temperature in the exhaust system is directly or indirectly detected, and when the wall temperature is a predetermined value or lower, it is regarded the condition that the water content in the exhaust is condensed in the exhaust system.

18. A heater control method of an air-fuel ratio sensor according to claim 16, wherein an engine cooling water temperature is detected, and when the water temperature is a predetermined value or lower, it is regarded the condition that the water content in the exhaust is condensed in the exhaust system.

19. A heater control method of an air-fuel ratio sensor according to claim 16, wherein an atmospheric temperature and an engine cooling water temperature are detected, and on a condition that the atmospheric temperature at an engine start time is a predetermined value or lower, when the water temperature is a predetermined value or lower, it is regarded the condition that the water content in the exhaust is condensed in the exhaust system.

20. A heater control method of an air-fuel ratio sensor according to claim 16, wherein an initial value of the power supply amount to said heater is set corresponding to the element temperature before the start of power supply to said heater, the power supply amount to said heater is set to said initial value when the power supply to said heater is started, and the power supply amount to said heater is set after the start of power supply to said heater so that the element temperature reaches a predetermined target temperature.

21. A heater control method of an air-fuel ratio sensor according to claim 20, wherein the initial value of the power supply amount to said heater is set to be smaller as the element temperature before the start of power supply to said heater is lower.

22. A heater control method of an air-fuel ratio sensor according to claim 20, wherein an engine cooling water temperature is detected, and the initial value of the power supply amount to said heater corresponding to the element temperature before the start of power supply to said heater, is corrected in accordance with the water temperature.

23. A heater control method of an air-fuel ratio sensor according to claim 20, wherein it is judged whether it is a time of the, start of power supply to said heater immediately after the engine start or it is a time of the restart of power supply to said heater during an engine operation, and the initial value of the power supply amount to said heater corresponding to the element temperature before the start of power supply to said heater, is set to different values in accordance with the judgment result.

24. A heater control method of an air-fuel ratio sensor which is mounted to an exhaust system of an internal combustion engine and equipped with a heater for heating a sensor element, wherein an element temperature is detected by measuring an impedance of said sensor element of said air-fuel ratio sensor, corresponding to the detected element temperature, an increase component of a power supply amount to said heater is set to be smaller as the element temperature is lower, and the power supply amount to said heater is feedforward controlled to be increased gradually by each increase component from a predetermined initial value.

25. A heater control method of an air-fuel ratio sensor according to claim 24, wherein the increase component of the power supply amount to said heater is set to be smaller as the element temperature is lower.

26. A heater control method of an air-fuel ratio sensor according to claim 24, wherein the increase component of the power supply amount to said heater is set to be smaller, compared to other conditions, on a condition that a water temperature in an exhaust system is a predetermined value or lower.

27. A heater control method of an air-fuel ratio sensor according to claim 24, wherein the initial value of the power supply amount to said heater is set corresponding to the element temperature before the start of power supply to said heater.

28. A heater control method of an air-fuel ratio sensor according to claim 27, wherein the initial value of the power supply amount to said heater is set to be smaller as the element temperature before the start of power supply to said heater is lower.

29. A heater control method of an air-fuel ratio sensor according to claim 27, wherein the initial value of the power supply amount to said heater is set to be smaller, compared to other conditions, on a condition that a water temperature in an exhaust system is a predetermined value or lower.

* * * * *